US009243463B2

(12) United States Patent
Hassard

(10) Patent No.: US 9,243,463 B2
(45) Date of Patent: Jan. 26, 2016

(54) COIL TUBING INJECTOR APPARATUS AND METHOD

(71) Applicant: Coil Solutions, Inc., Calgary, Alberta (CA)

(72) Inventor: Cecil C. Hassard, Redcliff, CA (US)

(73) Assignee: Coil Solutions, Inc., Redcliff, Alberta (CA)

( * ) Notice: Subject to any disclaimer, the term of this patent is extended or adjusted under 35 U.S.C. 154(b) by 394 days.

(21) Appl. No.: 13/743,832

(22) Filed: Jan. 17, 2013

(65) Prior Publication Data

US 2013/0240198 A1 Sep. 19, 2013

Related U.S. Application Data

(60) Provisional application No. 61/610,643, filed on Mar. 14, 2012.

(51) Int. Cl.
*E21B 19/22* (2006.01)

(52) U.S. Cl.
CPC ..... *E21B 19/22* (2013.01); *Y10T 29/49826* (2015.01)

(58) Field of Classification Search
CPC ..... E21B 19/22
See application file for complete search history.

(56) References Cited

U.S. PATENT DOCUMENTS

| | | | | |
|---|---|---|---|---|
| 5,188,174 | A | 2/1993 | Anderson, Jr. et al. | |
| 5,918,671 | A | 7/1999 | Bridges et al. | |
| 6,173,769 | B1 | 1/2001 | Goode | |
| 6,347,664 | B1 | 2/2002 | Perio, Jr. | |
| 6,609,566 | B2 | 8/2003 | Perio, Jr. | |
| 6,910,530 | B2 | 6/2005 | Austbo et al. | |
| 7,857,042 | B2 | 12/2010 | Koopmans et al. | |
| 8,191,620 | B2 | 6/2012 | Maschek, Jr. et al. | |
| 8,267,183 | B1 | 9/2012 | Maschek, Jr. et al. | |
| 2007/0137855 | A1* | 6/2007 | Nielsen et al. | 166/77.3 |
| 2012/0073833 | A1 | 3/2012 | McCulloch et al. | |
| 2013/0112433 | A1* | 5/2013 | Armstrong et al. | 166/385 |

OTHER PUBLICATIONS

International Search Report and Written Opinion of International Searching Authority completed Apr. 17, 2013, Canadian Intellectual Property Office, Gatineua, Quebec K1A 0C9.

* cited by examiner

*Primary Examiner* — William P Neuder
(74) *Attorney, Agent, or Firm* — Ramey & Schwaller, LLP

(57) ABSTRACT

A coiled tubing injector apparatus for inserting and/or removing coiled tubing from a well head comprising a first injector column and a second injector column forming a central pathway within a frame. The first and second injector columns each comprise an inner and outer band, the outer band containing a plurality of rolling elements for engaging the coiled tubing and the inner band creating drive force to energize the outer band. The inner band further comprises a wear plate designed to sustain the majority of wear for less costly maintenance and repair of injection heads.

16 Claims, 5 Drawing Sheets

COIL TUBING INJECTOR APPARATUS AND METHOD

This application claims benefit of U.S. Provisional Application No. 61/610,643 filed Mar. 14, 2012. The application listed above is incorporated herein by reference.

BACKGROUND OF THE INVENTION

1. Field of the Invention

The present invention relates generally to oilfield production equipment and, more particularly, to a coiled tubing injector apparatus for inserting and removing coiled tubing from a well.

2. Description of the Prior Related Art

Coiled tubing has seen a marked increase in use through the oil and gas industry since its inception. Coiled tubing operations have grown from the limited applications thought feasible in the early 1950's and are now considered a viable solution in multiple operations, including subsea wells, snubbing, fracturing, and even coiled tubing applications. Coiled tubing operations have grown more popular as a result of their rapid mobilization times and generally smaller footprint with respect to traditional well operations. Furthermore, they require less site crew and personnel, in addition to significant cost savings. As applications for coiled tubing have become more numerous, the strength and size of the coiled tubing has increased in options as well. Coiled tubing was generally less than 1 in. in diameter in the beginning, while it can be found now in sizes up to 4 in. in diameter.

Coiled tubing rigs primarily consist of an injector head for inserting and removing the coiled tubing from the wellhead, a spool reel for storing and transporting the coiled tubing, a power pack to power the injector head, and a control room to operate the machinery. The injector head is responsible for gripping the coiled tubing, usually through a series of grippers powered by a chain design, which provide enough force to move the tubing when necessary, without impeding the structural stability of the tubing. Although the other components are required to functionally operate the system, the injector head is the integral part of a coiled tubing rig.

The injector head comprises components that are subject to considerable wear and therefore require frequent maintenance.

The following patents discuss background art related to the above discussed subject matter:

U.S. Pat. No. 8,191,3520, issued Jun. 5, 2012, to Maschek, Jr. et al. discloses a gripper assembly for use within a coiled tubing injector unit. The gripper assembly comprises a carrier for securing the gripper to the chain drive mechanism of the coiled tubing injector unit and a gripping shoe carried by the carrier. The configuration of the gripper assembly permits removal and replacement of the gripping shoe.

U.S. Pat. No. 6,910,530, issued Jun. 28, 2005, to Austbo et al. discloses a coiled tubing injector apparatus for use in inserting coiled tubing into a well, temporarily suspending the coiled tubing, and removing the coiled tubing from the well is described. The apparatus includes a base with a pair of spaced-apart carriages extending upwardly therefrom. The base is part of a frame positioned above a wellhead. The carriages each have a gripper chain drive system rotatably mounted thereon and movable therewith. An actuation and linkage system allows the carriages to move toward and away from one another in a lateral or transverse direction with respect to the superstructure and the base. Thus, the gripper chain systems comprise gripper chains that can be engaged or disengaged from the coiled tubing extending through the apparatus. A wetting fluid basin is positioned below the gripper chains, and support guides engage the coiled tubing below the gripper chains to prevent buckling of the coiled tubing. The gripper chain drive system includes idler sprockets mounted on an idler sprocket shaft. The position of first and second ends of the idler sprocket shaft are monitored, and may be adjusted to maintain a parallel relationship with a drive sprocket shaft on which are mounted drive sprockets supporting the gripper chain.

U.S. Pat. No. 6,347,664, issued Feb. 19, 2002, to Perio, Jr. discloses a coiled tubing injector head comprised of a plurality of endless chains, each of which are at least three links wide, that are positioned around a plurality of sprockets and/or idler rollers within the injector head. A plurality of gripper assemblies are positioned around the middle links of the endless chains. A bearing skate is positioned within the injector head, the bearing skate being comprised of a plurality of bearings in a staggered configuration, the bearings being adapted for rolling engagement with a portion of the gripper assemblies. An injector head is comprised of a plurality of halves, each of the halves being coupled to a positioning bar, the positioning bar having a plurality of openings formed therein, the openings adapted for use in varying the distance between the first and second halves.

U.S. Pat. No. 6,173,769, issued Jan. 16, 2001, to Goode discloses a gripping element of a coiled tubing injector has a carrier and a removable gripping shoe mounted to the carrier. The removable shoe slides onto slots formed on the carrier and is floated on the carrier by inserting an elastomeric pad sandwiched between the carrier and shoe. A manually depressible spring along ones side of the carrier prevents the shoe from sliding out of the slots during operation of the injector.

U.S. Pat. No. 5,918,671, issued Jul. 6, 1999, to Bridges, et al. discloses an injector for flexible tubing has endless drive conveyors on opposite sides of a pathway for the tubing. The drive conveyors include gripper blocks that work in opposing pairs along the tubing pathway. The pairs of gripper blocks are clamped to the tubing and moved along the tubing pathway to either inject the tubing into a well or withdraw the tubing from a well. The gripper blocks are clamped to the tubing by way of skates, which work in opposing pairs. The skates have rollers, with rollers contacting the gripper blocks. Each roller has two ends, which ends are received by bearings inside of mounts on the respective skate.

The above discussed prior art does not address solutions provided by the present invention, which teaches a system that is useful for increasing reliability and reducing the frequency and time required for repairing and/or maintaining injection heads. Consequently, those skilled in the art will appreciate the present invention that addresses the above described and other problems.

SUMMARY OF THE INVENTION

A first possible object of the present invention is to provide a more reliable coiled tubing injector system for deep wells and high snubbing forces.

One possible object of the present invention is to provide an improved injector head assembly for a coiled tubing system.

Another possible object of the present invention is to provide a coiled tubing injector requiring reduced maintenance costs and down time during operation.

Yet another possible object of the present invention is to provide an improved chain on chain skate design for use with coiled tubing operations, including snubbing and workover operations.

These objects, as well as other objects, advantages, and features of the present invention will become clear from the description and figures to be discussed hereinafter. It is understood that the objects listed above are not all inclusive and are intended to aid in understanding the present invention, not to limit the scope of the present invention.

BRIEF DESCRIPTION OF THE DRAWINGS

A more complete understanding of the invention and many of the advantages thereto will be readily appreciated as the same becomes better understood by reference to the following detailed description when considered in conjunction with the accompanying drawings, wherein.

DESCRIPTION OF THE PREFERRED EMBODIMENT

Figure 1:
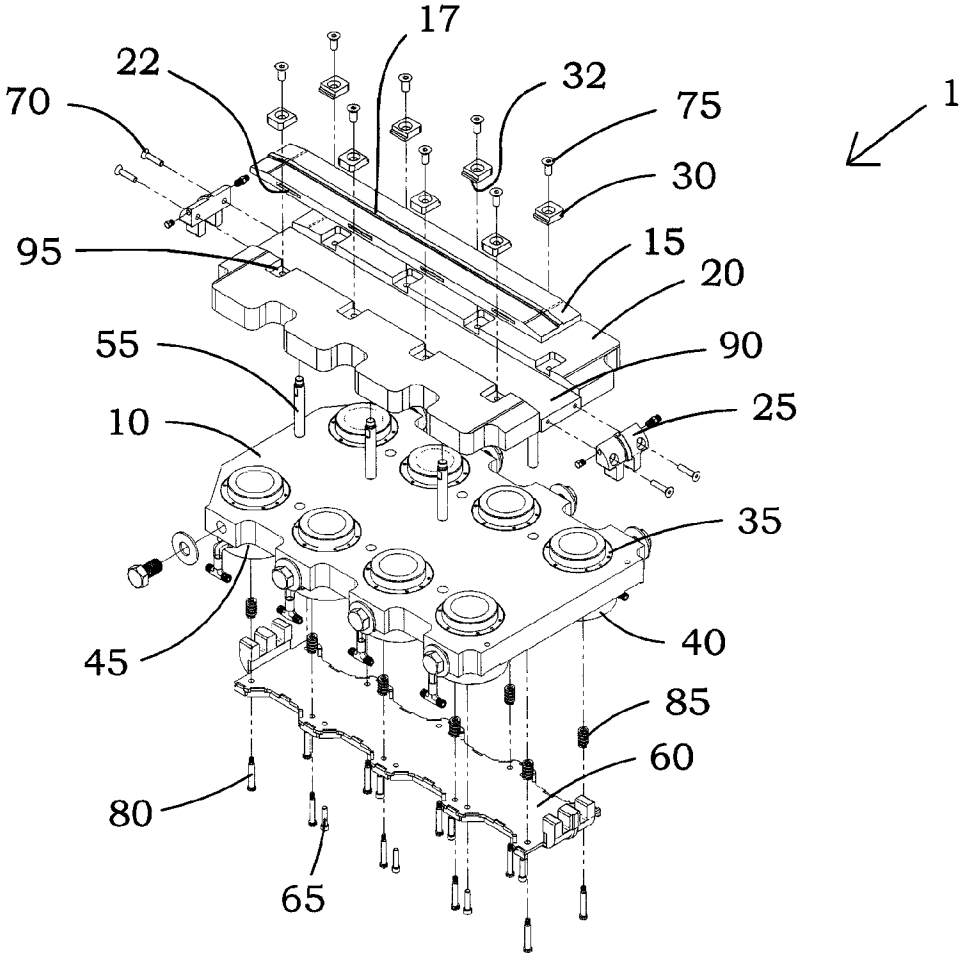
FIG. 1 is an exploded perspective view of a portion of a coiled tubing injector apparatus showing a skate plate in accord with one possible embodiment of the present invention.
Figure 5:
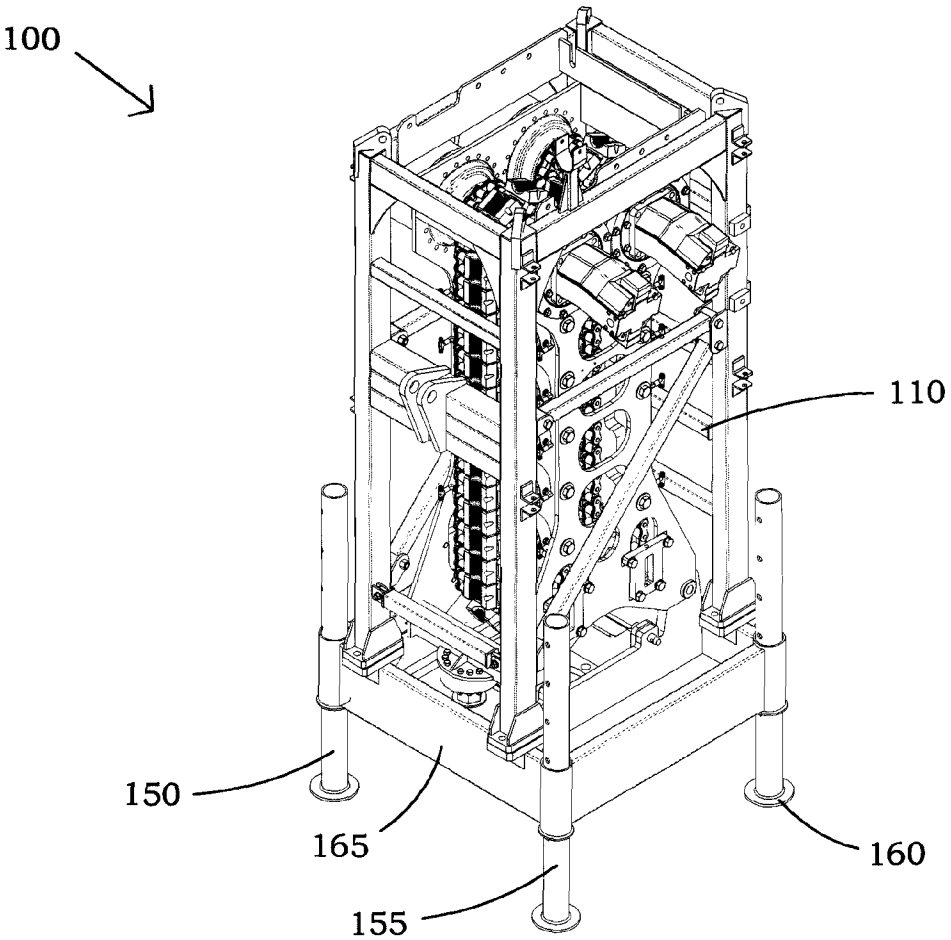
FIG. 5 is a perspective view of a coiled tubing injector apparatus in accord with one possible embodiment of the present invention

Referring now to the drawings, and more particularly to FIG. 1, there is shown an exploded view of internal assembly 1, which is a portion of coiled tubing injector apparatus 100, shown assembled in FIG. 5, in accord with one possible embodiment of the present invention. In one embodiment, existing coiled tubing injector units may be modified or retrofitted in accord with the present invention for longer and more reliable operation. In one embodiment, coiled tubing injector 100 utilizes a chain on chain skate design in which manufactured rollers may be connected to chain links, and is designed for various pulling and snubbing applications. Coiled tubing injector 100 can be used for conveying various sizes of coiled tubing into and out of wells for a variety of other oil and gas operations.

Internal assembly 1 utilizes center plate 10, which comprises a plurality of circular orifices in which cylinder retaining rings 35 retain hydraulic cylinders 40, in the process of compressing grippers that are used to grip the pipe. Skate plate 20 is located on a first side of center plate 10 and may be mounted to center plate 10 by support posts 55. Skate plate 20 may, in one embodiment, be rectangular shaped with elongated sides containing cutout portions that correspond with cylinder retaining rings 35 of center plate 10 so as not to interfere with the operation of hydraulic cylinders 40. Skate plate 20 further comprises channel 90 sized to receive elongate wear plate 15. In this embodiment, it is not necessary that the entire skate plate be comprised of hardened material designed for longer wear in response to friction. Moreover, wear to skate plate is limited for less expensive repairs. Wear plate 15 is clamped to skate plate 20 by a plurality of clamp plates 30, which fit within recesses 95 formed along channel 90 of skate plate 20. Wear plate 15 may be thicker than channel 90 and, if desired, extend outwardly from skate plate 20. Recesses 95 and clamp plates 30 may be shaped differently than shown and could be elongate. Clamp plates 30 further each comprise at least one tongue 32 which fit within corresponding slots 22 of wear plate 15. Tongue 32 may be rectangular, round, or the like. In another embodiment, clamp plates 30 may be machined onto wear plate 15 with tongue 32 for insertion into corresponding recess 95 on skate plate 20.

Cap screws 75 further secure clamp plates 30 to skate plate 20, but do not bear any of the lateral forces created through operation of coiled tubing injector 100. The lateral forces on clamp plates 30 are supported by the walls of recesses 95 and the walls of slots 22, therefore cap screws 75 need only fasten clamp plates 30 to skate plate 20, a force which is not resisted during operation.

Tensioner assembly 60 is located on an opposite side of center plate 10 with respect to skate plate 20 and secured to center plate 10 by bolts 80 and socket head screw 65. Other types of fasteners may be utilized for this operation. Tensioner assembly 60 supports a plurality of injector springs 85 corresponding with hydraulic cylinders 40 respectively. Injector springs 85 expand and compress in response to the force exerted by hydraulic cylinders 40 during operation. Cylinder spacers 45 are placed between hydraulic cylinders 40 and center plate 10 for alignment purposes and to provide extended operation to account for size differences in coiled tubing. Tensioner assembly 60 comprises at least two prong sets which are for connecting with at least two of side plates 25 for securing tensioner assembly 60 with skate plate 20. Side plates 25 interlock with tensioner assembly 60 and then are secured to skate plate 20 by small cap screws 70. In other embodiments, alternative means of attaching side plates 25 with skate plate 20 may be used including pins, clamps, and the like. Side plates 25 mate with wear plate 15 and guide chain assembly 50 around skate plate 20 and wear plate 15. In one embodiment, wear plate 15 comprises track 17 upon which chain assembly 50 revolves along during operation of coiled tubing injector apparatus 100, to be discussed in more detail hereinafter.

Figure 2:
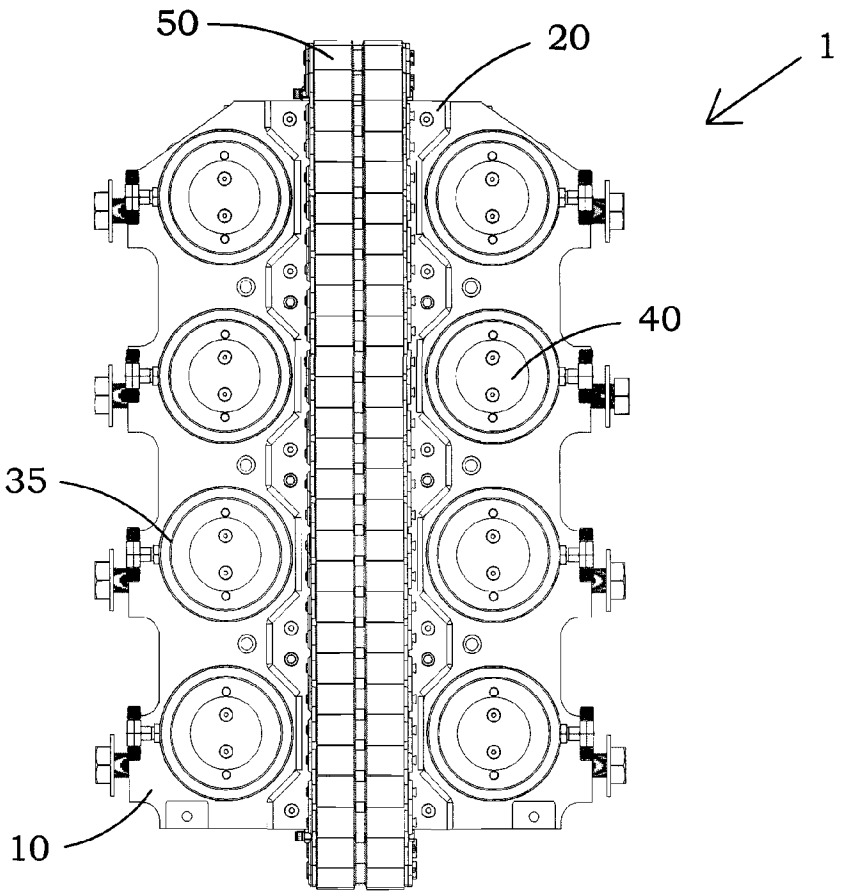
FIG. 2 is a top elevational view of a part of a coiled tubing injector apparatus showing a chain drive and skate plate in accord with one possible embodiment of the present invention.

Turning now to FIG. 2, a top view of internal assembly 1, with respect to the view of FIG. 1, is depicted in accord with one possible embodiment of the present invention. Chain assembly 50 comprises a plurality of rollers interconnected by a series of chain links rotating along track 17 of wear plate 15 (See FIG. 1). However, the present invention is not limited to the current depiction of chain assembly 50 and may include alternative configurations in accord with the present invention. In another embodiment, chain assembly 50 may further comprise a skate cylinder traction beam and an alternative drive chain tension system, i.e. chain sprockets, planetary gears, hydraulic motors and/or controls, and the like may be used to drive chain assembly 50. Skate plate 20 is fashioned to fasten with center plate 10 so that it does not interfere with hydraulic cylinders 40 or cylinder retaining rings 35 during normal operation of coiled tubing injector apparatus 100.

Figure 3:
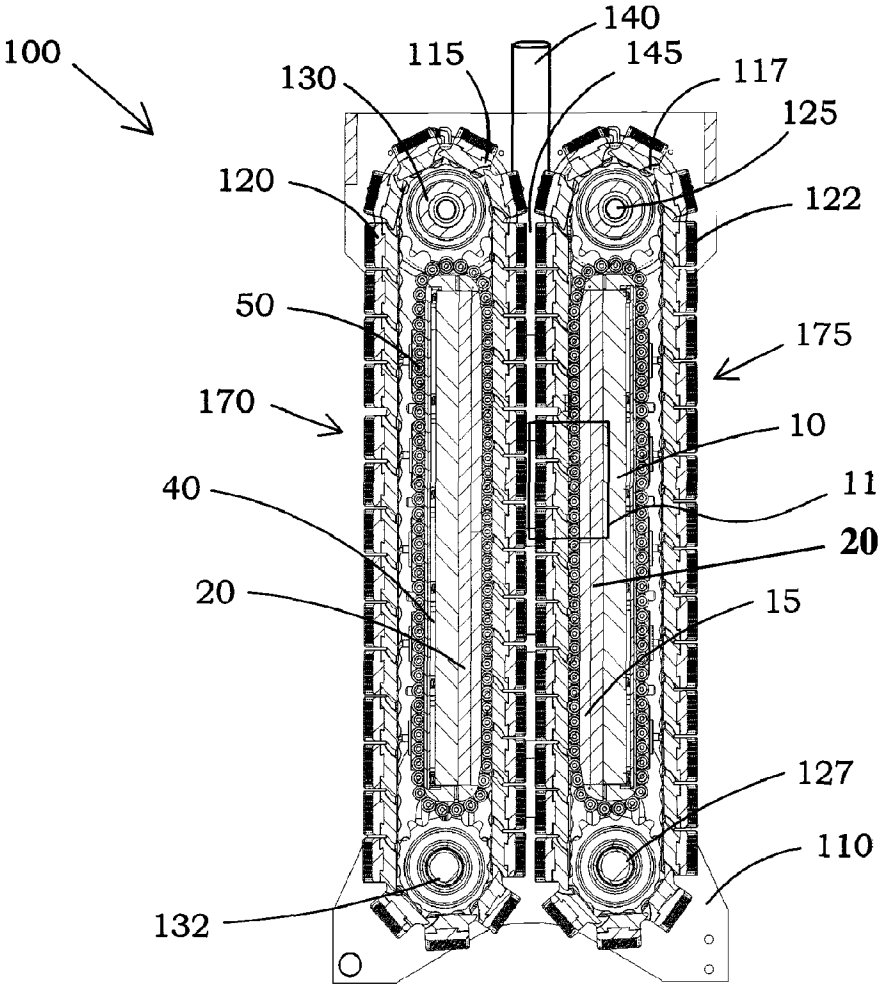
FIG. 3 is an elevational view, in section, of a coiled tubing injector apparatus in accord with one possible embodiment of the present invention.

In FIG. 3, a front sectional view of coiled tubing injector 100 is depicted in accord with a preferred embodiment of the present invention. Coiled tubing injector 100 comprises first injector component 170 and second injector component 175 housed within frame 110. First injector component 170 and second injector component 175 may be identical or substantially identical in structure with regards to internal assembly 1 as described in conjunction with FIG. 1 and oppose each other with respect to central pathway 145. In operation, first injector component 170 and second injector component 175 are used in conjunction to insert and/or remove coiled tubing 140 from central pathway 145 using grippers 120, 122. Grippers 120,122 interconnect with gripper bands 115, 117 respectively, with gripper band 115 revolving around gears or sprocket pair 130, 132, and gripper band 117 revolving around gears or sprocket pair 125, 127 respectively. In an alternative embodiment, gripper bands 155, 177 may be fashioned with grippers 120, 122 as a single, unified component.

Grippers 120,122 apply pressure to coiled tubing 145 after being energized by hydraulic cylinders 40 being operated either manually or automatically, typically at a control room or at controls on frame 110. Hydraulic cylinders 40 are operable to expand and contract, thereby changing the pressure grippers 120, 122 apply onto coiled tubing 145, as well as converging first injector component 170 and second injector component 175 towards each other. Grippers 120, 122 may comprise a semicircular channel which provides a better contact area with coiled tubing 140, although various shapes of grippers 120, 122 may be employed consistent with the teachings of the present invention. In some embodiments, grippers 120,122 may, if desired, comprise a substantially resilient material to depress for engaging with smaller diameter tubing or expand to handle larger diameter tubing.

Figure 4:
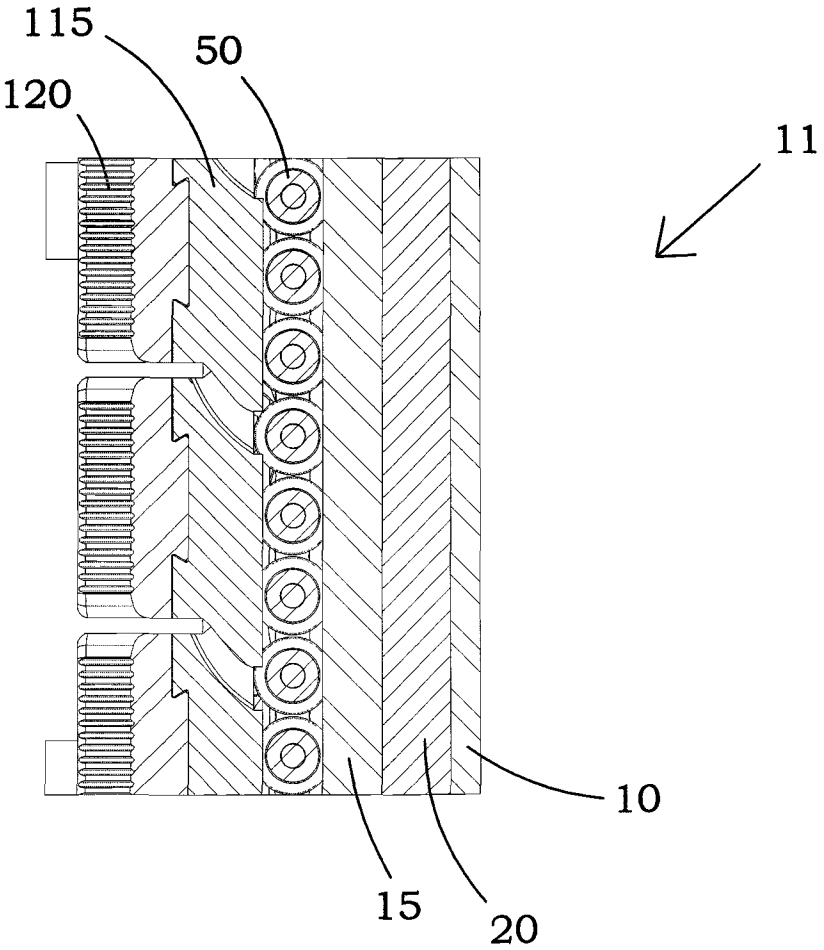
FIG. 4 is a side elevational view of a coiled tubing injector, partially in section, of section 10 of FIG. 3, in accord with one possible embodiment of the invention.

In FIG. 4, an enlarged front view of Section 11 of coiled tubing injector 100 as shown in FIG. 3 is depicted in accord with one possible embodiment of the present invention. Center plate 10, skate plate 20, and wear plate 15 are arranged as described in detail when discussing FIG. 1. Chain assembly 50 makes contact with gripper assembly 120 providing a drive force to move gripper assembly during operation of coiled tubing injector apparatus 100. In this embodiment, gripper assembly 120 further comprises carriers 115 for direct contact with chain assembly 50. This arrangement prevents any undue wear upon skate plate 20 and provides for quicker and easy replacement of wear plate 15 instead of the more expensive skate plate 20, which is also harder to replace.

Referring now to FIG. 5, coiled tubing injector apparatus 100 is shown with adjustable base 165 for adjusting to various size wellheads. Adjustable base 165 is supported by posts 150, 155, 160 while the components of coiled tubing injector apparatus 100 as described hereinbefore are contained within frame 110.

The invention claimed is:

1. A coiled tubing injector apparatus for inserting and removing coiled tubing from a wellhead, comprising:

a first and second band of opposed gripping members arranged for gripping said coiled tubing in a central pathway;

a first and second inner chain operable to drive said first and second bands;

a first and second skate plate, each of said first and second skate plate defining a channel and a plurality of recesses along both sides of said channel;

a wear plate sized to fit within said channel of each said skate plate, said wear plate further comprising a plurality of openings, wherein said plurality of recesses and said plurality of openings align when said wear plate is inserted into said channel of each said skate plate; and a plurality of clamps for fastening each said wear plate to each said skate plate, wherein a first end of said plurality of clamps fits within said plurality of recesses and a second end of said plurality of clamps defines a tongue for insertion in said plurality of openings.

2. The apparatus of claim 1, further comprising at least one hydraulic cylinder operable for selectively compressing said first and second band of opposed gripping members.

3. The apparatus of claim 1, wherein said plurality of clamps are secured within said plurality of notches with a plurality of fasteners.

4. The apparatus of claim 1, wherein said plurality of recesses each comprise a rectangular shaped aperture.

5. The apparatus of claim 1 further comprising first and second end plates positioned on each end of said wear plate.

6. The apparatus of claim 5, wherein each of said first and second end plates comprise a curved surface.

7. The apparatus of claim 1, wherein said wear plate is thicker than said channel so as to extend outwardly from each of said first and second skate plates.

8. The apparatus of claim 1, further comprising a first and second center plates positioned on an opposite side from said wear plate for said first and second skate plates.

9. The apparatus of claim 1, wherein said wear plate comprises a center track.

10. A coiled tubing injector apparatus, comprising:

a first injector column comprising a skate plate and a wear plate, said skate plate comprising a central track sized to receive said wear plate and a plurality of indentions along both sides of said central track, said wear plate further comprising a plurality of slots, wherein said plurality of slots and said plurality of indentions align when said wear plate is inserted into said central track of said skate plate;

a second injector column comprising a skate plate and a wear plate, said skate plate comprising a central track sized to receive said wear plate and a plurality of indentions along both sides of said central track; and a plurality of clamps for fastening said wear plate to said skate plate of both said first injector column and said second injector column, each of said plurality of clamps forming an extension of said wear plate aligning with said plurality of indentions and operable for securing said wear plate in position relative to said skate plate.

11. The apparatus of claim 10, wherein said plurality of clamps each further comprise a tongue for insertion into said plurality of indentions of said skate plate.

12. The apparatus of claim 10, wherein said plurality of clamps are separate from said wear plate and fit within a plurality of slots within said wear plate.

13. The apparatus of claim 10, wherein said coiled tubing injector apparatus is housed within a frame.

14. The apparatus of claim 10 wherein said first and second injector columns further comprise first and second inner chains each further comprising a plurality of rolling elements.

15. The apparatus of claim 10 further comprising a plurality of hydraulic cylinders operable for exerting a compressing force on a plurality of gripping members to remove and/or insert a coiled tubing from a central pathway.

16. A method of manufacturing for a coiled tubing injector apparatus, comprising:

providing a first and second outer chain each further comprising a plurality of gripping members revolving around an outer pathway, said first and second outer chains arranged so that a gripping surface of said plurality of gripping members oppose each other with respect to a central pathway;

inserting a first and second inner chain within said outer pathway of said first and second outer chains respectively, wherein said first and second inner chains further comprise a plurality of rolling elements for engaging with a backside of said plurality of gripping members;

assembling a first and second injector head each comprising a plurality of hydraulic cylinders and a skate plate, said first and second injector head providing an axis for said first and second inner chain to revolve around, said skate plate comprising a central channel sized to receive a wear plate and a series of channel indentations along the sides of said central channel, said wear plate further comprising a plurality of recesses, wherein said plurality of recesses and said series of channel indentations align when said wear plate is inserted into said central channel of said skate plate; and providing a plurality of clamp plates for fastening said wear plate to said skate plate, said plurality of clamp plates mating with said series of channel indentations and overlapping said plurality of recesses whereby forces produced during operations of said coiled tubing injector apparatus are distributed between said wear plate and said skate plate.

* * * * *